US011448056B2

(12) United States Patent
DiFoggio

(10) Patent No.: US 11,448,056 B2
(45) Date of Patent: Sep. 20, 2022

(54) FLUID SEPARATION USING IMMERSED HYDROPHILIC AND OLEOPHILIC RIBBONS

(71) Applicant: Rocco DiFoggio, Houston, TX (US)

(72) Inventor: Rocco DiFoggio, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/953,652

(22) Filed: Nov. 20, 2020

(65) Prior Publication Data

US 2022/0162936 A1 May 26, 2022

(51) Int. Cl.
*E21B 43/38* (2006.01)
*E21B 43/12* (2006.01)

(52) U.S. Cl.
CPC ..... *E21B 43/38* (2013.01); *E21B 43/12* (2013.01)

(58) Field of Classification Search
CPC ..... E21B 43/12; E21B 43/34; E21B 43/36; E21B 43/38; E21B 43/385; B01D 17/02; B01D 17/0202; B01D 17/0217; B01D 17/041; B01D 17/047
See application file for complete search history.

(56) References Cited

U.S. PATENT DOCUMENTS 3,794,583 A * 2/1974 Rhodes ..... B01D 17/0202 210/649
3,810,832 A * 5/1974 Rhodes ..... B01D 17/0202 210/649
4,257,895 A * 3/1981 Murdock ..... B01D 17/0211 210/243
4,416,782 A * 11/1983 Kerres ..... B01D 17/045 210/483
7,198,718 B1 * 4/2007 Turnbull ..... B01D 17/045 210/232
9,109,423 B2 8/2015 Dykstra et al.
10,689,268 B1 6/2020 Jamison et al.
(Continued)

OTHER PUBLICATIONS

Schlumberger Oilfield Glossary for "hydrophilic", accessed Jan. 10, 2022 via glossary.oilfield.slb.com.*
(Continued)

*Primary Examiner* — Blake Michener
(74) *Attorney, Agent, or Firm* — Cantor Colburn LLP

(57) ABSTRACT

An apparatus for separating fluids and controlling flow of production fluid includes a diversion assembly configured to receive production fluid produced from a subterranean region, the diversion assembly including an inflow conduit in fluid communication with a first outflow conduit and a second outflow conduit, the first outflow conduit in fluid communication with a surface location. The apparatus also includes a separation assembly including a hydrophilic ribbon and an oleophilic ribbon configured to be immersed in the production fluid, at least part of the hydrophilic ribbon and the oleophilic ribbon configured to move with the production fluid, the oleophilic ribbon configured to redirect a flow of hydrocarbons into the first outflow conduit, and the hydrophilic ribbon configured to redirect a flow of water-based fluid into the second outflow conduit.

20 Claims, 5 Drawing Sheets

(56) References Cited

U.S. PATENT DOCUMENTS

| | | | |
|---|---|---|---|
| 2014/0209297 | A1 | 7/2014 | Holderman |
| 2019/0040714 | A1 | 2/2019 | Fripp et al. |

OTHER PUBLICATIONS

Ding et al. "One-Step Preparation of Highly Hydrophobic and Oleophilic Melamine Sponges via Metal-Ion-Induced Wettability Transition", ACS Appl. Mater. Interfaces 2018, 10, 6652-6660.
Gao et al. "Downhole Separation Technology—Past, Present and Future", APPEA Journal 2007, Part 1—281-290.
Hashem "Development of Centrifugal Downhole Oil/Water Separator: Simualtion and Experimental Study" Society of Petroleum Engineers, SPE-184494-STU, 2016, 25 pages.
Molina et al. "Hydrophilic-oleophobic coatings on cellulosic materials by plasma assisted polymerization in liquid phase and fluorosurfactant complexation", Cellulose, Feb. 2014, 12 pages.

* cited by examiner

FLUID SEPARATION USING IMMERSED HYDROPHILIC AND OLEOPHILIC RIBBONS

BACKGROUND

Exploration and production of hydrocarbons require a number of diverse activities from various engineering fields to be performed in a borehole penetrating an earth formation. Typically, exploration involves surveying and performing measurements known as logging using a survey or logging tool. Production generally involves activities such as drilling, casing perforation, hydraulic fracturing, formation evaluation, well integrity surveys, well stimulation, production logging, others.

Production fluid flowing through a borehole often includes a mixture of a variety of materials and fluids. Produced fluid can include solids such as sand and cuttings, as well as various hydrocarbon and non-hydrocarbon fluids, including oil, natural gas, non-hydrocarbon gases and water. Typically, production operations involve processing production fluids to remove unwanted materials and water therefrom.

SUMMARY

An embodiment of an apparatus for separating fluids and controlling flow of production fluid includes a diversion assembly configured to receive production fluid produced from a subterranean region, the diversion assembly including an inflow conduit in fluid communication with a first outflow conduit and a second outflow conduit, the first outflow conduit in fluid communication with a surface location. The apparatus also includes a separation assembly including a hydrophilic ribbon and an oleophilic ribbon configured to be immersed in the production fluid, at least part of the hydrophilic ribbon and the oleophilic ribbon configured to move with the production fluid, the oleophilic ribbon configured to redirect a flow of hydrocarbons into the first outflow conduit, and the hydrophilic ribbon configured to redirect a flow of water-based fluid into the second outflow conduit.

An embodiment of a method of separating fluids and controlling flow of production fluid includes disposing a fluid production apparatus in a borehole in a subterranean region, the apparatus including a diversion assembly having an inflow conduit in fluid communication with a first outflow conduit and a second outflow conduit, the first outflow conduit in fluid communication with a surface location, the apparatus including a separation assembly having a hydrophilic ribbon and an oleophilic ribbon configured to be immersed in the production fluid, at least part of the hydrophilic ribbon and the oleophilic ribbon configured to move with the production fluid. The method also includes receiving production fluid produced from the subterranean region, the production fluid including an initial proportion of hydrocarbons and an initial proportion of water-based fluid, flowing the production fluid into the inflow conduit. The method further includes redirecting hydrocarbon fluid in the production fluid to the first outflow conduit by the oleophilic ribbon, to reduce the proportion of the water-based fluid in the first outflow conduit relative to the initial proportion of the water-based fluid, redirecting water-based fluid of the production fluid to the second outflow conduit by the hydrophilic ribbon, to reduce the proportion of the hydrocarbons in the second outflow conduit relative to the initial proportion of the hydrocarbons, and receiving the second portion of the production fluid at a surface location.

BRIEF DESCRIPTION OF THE DRAWINGS

The following descriptions should not be considered limiting in any way. With reference to the accompanying drawings.

DETAILED DESCRIPTION

Figure 1:
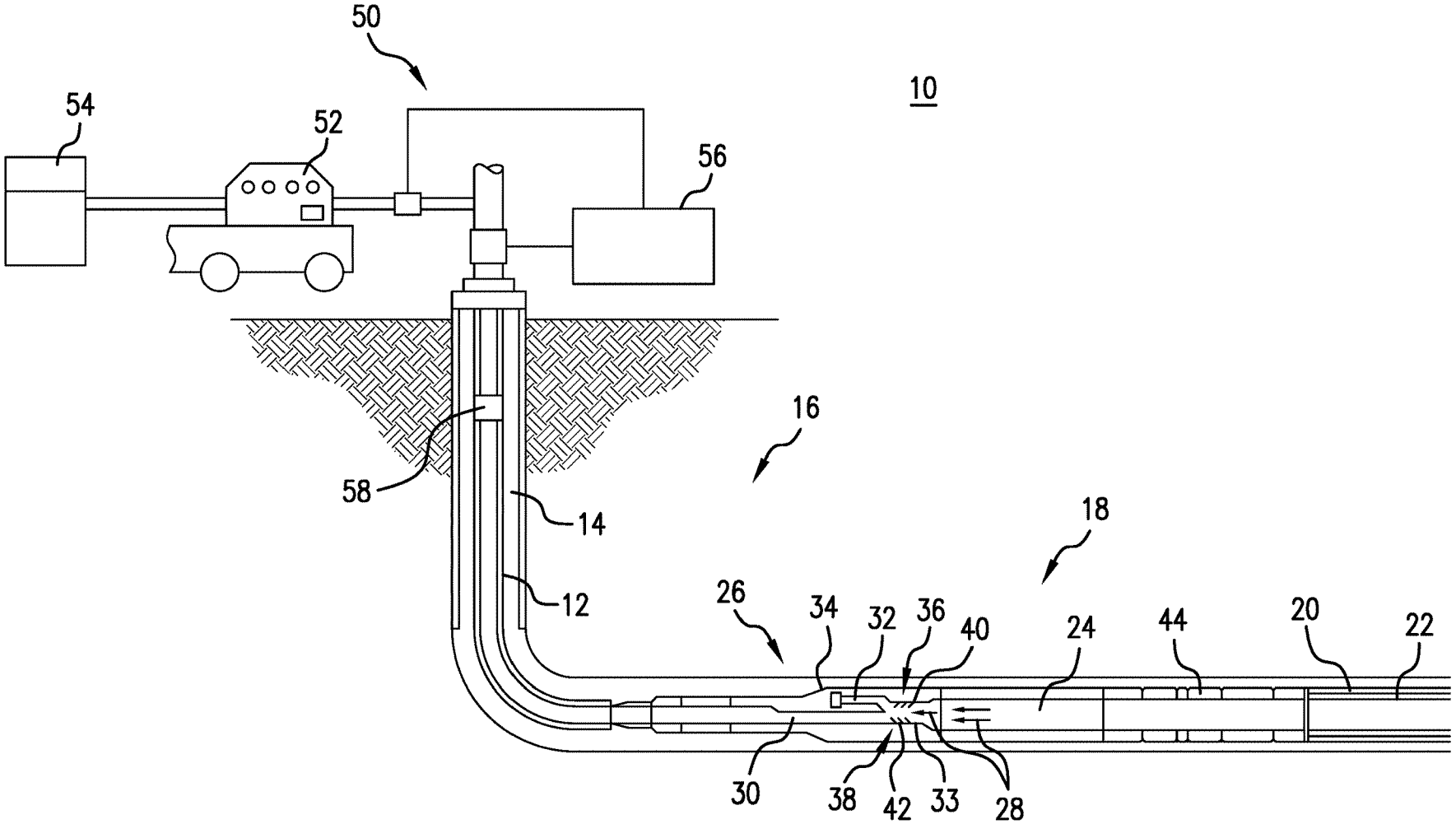
FIG. 1 illustrates an embodiment of a system for performing subterranean operations, the system including a downhole fluid separation assembly.

A detailed description of one or more embodiments of the disclosed apparatus and method presented herein by way of exemplification and not limitation with reference to the figures.

Systems, devices and methods are provided herein for performing aspects of fluid production from a hydrocarbon bearing formation or other subterranean region. An embodiment of a fluid separation system is configured to separate hydrocarbon fluids from water-based fluids in production fluid.

In one embodiment, the fluid separation system includes one or more hydrophilic members that are made from or include a hydrophilic and oleophobic material, and the oleophilic component includes a one or more oleophilic members that are made from or include an oleophilic and hydrophobic material. For example, each hydrophilic member and each oleophilic member is a flexible member, such as a filament, a bundle of filaments, a woven structure or a ribbon, which is fixed at one end relative to a surface of one or more fluid conduits. A flat ribbon strip has a higher surface to volume ratio, which makes it preferable to a filament having a round or nearly-round cross section. Another end of the flexible member extends into the path of fluid flow and is unattached so that the member can freely float within fluids. A liquid's wettability for some solid surface is measured by the contact angle that a droplet of that liquid makes with that solid surface. Common wettability definitions are "super philic" for contact angles less than 10 degrees, "philic" for contact angles between 10 and 90 degrees, "phobic" for contact angles between 90 and 150 degrees, and "super phobic" for contact angles greater than 150 degrees. When the liquid is water, these contact angles describe the ranges for superhydrophilic to superhydrophobic. When the liquid is oil, these contact angles describe the ranges for superoleophilic to superoleophobic.

The hydrophilic and oleophilic members are selectively placed within a fluid conduit to achieve the separation. For example, a fluid separation system includes an inflow conduit in fluid communication with production fluid, where the production fluid includes fluids and materials entering a borehole from a subterranean region. The fluid separation system also includes a first outflow conduit in fluid communication with the surface (also referred to as a "production outflow conduit"), and a second outflow conduit. The oleophilic members are arranged in the fluid separation system so that hydrocarbon-based fluids (referred to simply as "hydrocarbons") are preferentially guided into the first outflow conduit. The hydrophilic members are also arranged so that water-based fluids are preferentially guided into the second outflow conduit.

In one embodiment, the one or more oleophilic members include one or more oleophilic ribbons configured to be wet only by hydrocarbons (or other oil-based fluids) that are in close proximity to each ribbon in the production fluid, and to guide at least hydrocarbons within the viscous boundary layer around the ribbon into a first outflow conduit (e.g., a mostly-oil outflow line). Similarly, the one or more hydrophilic members include one or more hydrophilic ribbons configured to be wet only by water-based fluids that are in close proximity to each ribbon in the production fluid, and to guide at least water-based fluid within the viscous boundary layer around the ribbon into a second outflow conduit (e.g., a mostly-water outflow line). The hydrophilic ribbons and the oleophilic ribbons are configured to selectively direct their respective fluids so as to increase or maximize the amount of oil in the first outflow conduit.

Each ribbon can be bent by 90 degrees with the application of a very small amount of force (e.g., of one ounce or less) and also has a high surface to volume ratio. For example, each ribbon can have a relatively long length and a relatively large width to increase or maximize surface area. For example, each ribbon is a wide and flat ribbon having an extended length.

In one embodiment, the different wettability ribbons are intermingled within the inflow conduit, with the oil-wet oleophilic ribbons terminating in the production outflow conduit, and the water-wet hydrophilic ribbons terminating in the second outflow conduit. The ribbons can sway, wave, undulate and otherwise move with the production fluid, analogous to ribbons blowing in the wind. It is noted that a "ribbon" as described herein is defined as any elongated, flexible member that can flow or move with fluid flow without significantly restricting fluid flow in the inflow conduit. A ribbon can have any of a variety of shapes, sizes and dimensions, and be made from a variety of materials. In one embodiment, the oil-wet ribbons are superhydrophobic and/or the water-wet ribbons are superoleophobic.

The hydrophilic and oleophilic ribbons may be made from a variety of materials. For example, one or more hydrophilic ribbons are made from or coated with one or more hydrophilic materials, such as one or more high temperature polymers. One or more oleophilic ribbons are made from or coated with, for example, a high temperature polymer such as Kevlar or Melamine resin. A "high temperature" material as described herein is a material able to withstand temperatures in a downhole environment, which can reach 150 C or even 200 C or more.

As production fluid flows through the inflow conduit, water-based fluids are preferentially redirected, as each hydrophilic ribbon results in an increased surface area (relative to conduits without such a component) at which water-based fluids adhere. The hydrophilic ribbon or ribbons are arranged so that water-based fluids contact and/or are attracted to the hydrophilic component; as a result, fluid flowing into the production outflow conduit has a lower concentration or proportion of water-based fluids than the production fluid entering the inflow conduit.

Likewise, hydrocarbons are preferentially redirected by the oleophilic ribbon or ribbons. The oleophilic ribbon or ribbons are arranged so that hydrocarbons contact and/or are attracted to the oleophilic ribbon or ribbons, thereby reducing the concentration or proportion of hydrocarbon fluids in the second outflow conduit, as compared to production fluid entering the inflow conduit As described herein, a "production fluid" is a fluid that includes formation fluid produced from a resource bearing formation. Production fluid may include various constituent fluids, including hydrocarbon fluids such as oil, hydrocarbon gas (e.g., methane and natural gas), non-hydrocarbon gas (e.g., hydrogen sulfide), and others. The production fluid may also include water-based fluids, i.e., water or water having gases and other substances dissolved therein.

The fluid separation assembly or components thereof can be combined with other separation mechanisms or devices. For example, by combining with hydrocyclones or other fluid separation technologies, even higher concentrations of the intended phases can be achieved in the two outflow lines.

Embodiments described herein provide a number of advantages and technical effects. For example, the fluid separation assembly provides an effective and passive way to facilitate downhole separation of production fluid, in order to reduce the amount of non-hydrocarbon fluid produced at the surface. This can serve to reduce the need for additional processing at the surface. In addition, the fluid separation assembly can be incorporated into pre-existing downhole fluid conduits and/or incorporated with less complexity and special requirements than other downhole fluid separation technologies, such as hydrocyclones. The fluid separation assembly can be readily combined with other separation technologies. In addition, the separation ribbons described herein can be disposed in fluid conduits without significantly affecting flow rate or causing clogging, which is advantageous over other separation mechanisms such as filters or membranes. These separation ribbons are passive. They do not need external power or a control system to be effective although such things can be added as option.

Any system that simply uses a selective-wettability inner pipe surface has a very limited amount of surface area that is interacting with the passing fluids. Furthermore, selective-wettability filters, which can have significant surface area, unfortunately also significantly reduce the flow rate of fluids through them, e.g., by a factor of one hundred or more compared to the ribbons described herein. By contrast, using selective-wettability ribbons in the flow line allows one to increase the volume of fluid that is in contact with selective wettability surfaces by simply increasing the number of ribbons so as to achieve a factor of ten or, perhaps, even a factor of a hundred improvement, and to do so with comparatively little restriction to flow.

Referring to FIG. 1, an embodiment of a resource or energy production system 10 includes a borehole string 12 disposed in a borehole 14 extending into a subterranean region or a resource bearing formation, such as an earth formation 16. The borehole string 12 is configured as, for example, a production string that establishes a production conduit through which production fluid is brought to the surface. As described herein, "borehole" or "wellbore" refers to a hole that makes up all or part of a drilled well. It is noted that the borehole 14 may include vertical, deviated and/or horizontal sections, and may follow any suitable or desired path. As described herein, "formations" refer to the various features and materials that may be encountered in a subsurface environment and surround the borehole 14.

For example, the borehole string 12 includes a completion string having a production assembly 18. The production assembly 18 may include components for facilitating flow of borehole fluid into the borehole 14, such as such as a sand screen 20 and an inflow control assembly 22. The inflow control assembly may include components such as valves, inflow control devices (ICDs) and other components. The production assembly 18 may also include an electric submersible pump (ESP) 24 or other artificial lift device or system. The borehole string 12 and/or the production assembly 18 may include other components to facilitate production, such as, a fracture or "frac" sleeve device and/or a perforation assembly. It is noted that the separation ribbons described herein (and/or other separation components) can be incorporated into one or more of the above components.

The production assembly 18 and/or completion string includes a fluid separation system 26 configured to separate water-based fluids from production fluid 28. The separation system 26 is configured to divert the production fluid 28 into a first or production outflow conduit 30 and a second outflow conduit 32. The system 26 can divert fluid using any of a variety of configurations. For example, the borehole string 12 includes a production (inflow) conduit 33 such as a pipe or tubular, which splits into the outflow conduits via a diverter sub 34. The production outflow conduit 30 may be in fluid communication with surface equipment, and the second outflow conduit may be in fluid communication with an annulus of the borehole 14, a surface location, the formation 16, an injection formation (not shown) or any other suitable location.

The fluid separation system 26 also includes a hydrophilic separation component 36 and an oleophilic separation component 38. A "separation component" as described herein may include a single component (e.g., a sheet or layer) or multiple components (e.g., multiple ribbons or other members). Both the hydrophilic separation component 36 and the oleophilic separation component 38 are configured to extend into the inflow conduit 33, the outflow conduit 30 and/or the outflow conduit 32.

A "hydrophilic" component refers to a component that has hydrophilic properties that cause water-based fluids to be attracted thereto, causing water-based fluids to adhere to the component and to redirect the flow of the water-based fluid. The hydrophilic component may also be oleophobic, by which hydrocarbon fluids are repelled by the component. An "oleophilic" component refers to a component that has oleophilic properties that cause hydrocarbon fluids to be attracted thereto, causing the hydrocarbon fluids to adhere to the component and to redirect the flow of the hydrocarbon fluids. The oleophilic component may be hydrophobic and thereby repel water-based fluids.

In one embodiment, the hydrophilic separation component 36 includes one or more hydrophilic ribbons, and the oleophilic separation component 38 includes one or more oleophilic ribbons. The ribbons are disposed in the separation system 26 such that a first volume of the production fluid 28 flowing toward production outflow conduit 30 interacts with the oleophilic separation component 38, and such that a second volume of the production fluid 28 flowing toward the outflow conduit 32 interacts with the hydrophilic separation component 36.

The separation ribbons or other components 36 and 38 are thus arranged in the system 26 so that hydrocarbons in the production fluid are urged toward the production outflow conduit 30, and so that water and water-based fluids are urged toward the second outflow conduit 32. A result is that fluid flowing into the production outflow conduit 30 has a relatively high concentration of hydrocarbons (as compared to the production fluid 28 entering the inflow conduit 33), and fluid flowing into the second outflow conduit 32 has a relatively high concentration of water and water-based fluids.

The separation ribbons or other components 36 and 38 can be arranged in a number of ways in order to separate hydrocarbon fluids and water-based fluids. In one embodiment, at least part of the hydrophilic separation component 36 is located proximate to entrance of the second outflow conduit 32, and at least part of the oleophilic separation component 38 is located proximate to entrance of the production outflow conduit 30. As described herein, a component is "proximate" to an entrance when the component is at a location that is close enough to the entrance so that a portion of fluid that flows into the entrance interacts with the component.

In one embodiment, the separation ribbons or other components 36 and 38 can be placed along radially opposing surfaces of the inflow conduit 33. For example, as shown in FIG. 1, the hydrophilic separation component 36 includes a plurality of hydrophilic ribbons 40 arrayed along a surface of the inflow conduit 33 and/or along a surface of the second outflow conduit 32. The oleophilic separation component 38 includes a plurality of oleophilic ribbons 42 arrayed along a surface of the inflow conduit 33 and/or along a surface of the production outflow conduit 30.

The borehole string 12 and/or the production assembly 18 may include additional components. For example, the production assembly includes one or more packer assemblies 44. Each packer assembly 44 includes one or more packer elements, which are actuated to isolate components and/or zones in the borehole 12. For example, multiple packer assemblies 44 can be used to establish production zones around the borehole 14.

The system 10 also includes surface equipment 50 such as a drill rig, rotary table, top drive, blowout preventer and/or others to facilitate deploying the borehole string 12, operating various downhole components, monitoring downhole conditions and controlling fluid circulation through the borehole 14 and the borehole string 12. In one embodiment, the surface equipment 50 includes a fluid control system 52 including one or more pumps in fluid communication with a fluid tank 54 or other fluid source. The fluid control system 52 facilitates injection of fluids, such as drilling fluid (e.g., drilling mud) and stimulation fluid (e.g., a hydraulic fracturing fluid).

In one embodiment, the system 10 includes a processing device such as a surface processing unit 56, and/or a subsurface processing unit 58 disposed in the borehole 14 and connected to one or more downhole components. The processing device may be configured to perform functions such as controlling downhole components, transmitting and receiving data, processing measurement data and/or monitoring operations. The processing device may also control aspects of fluid circulation, such as fluid pressure and/or flow rate in the borehole string 12.

Figure 2:
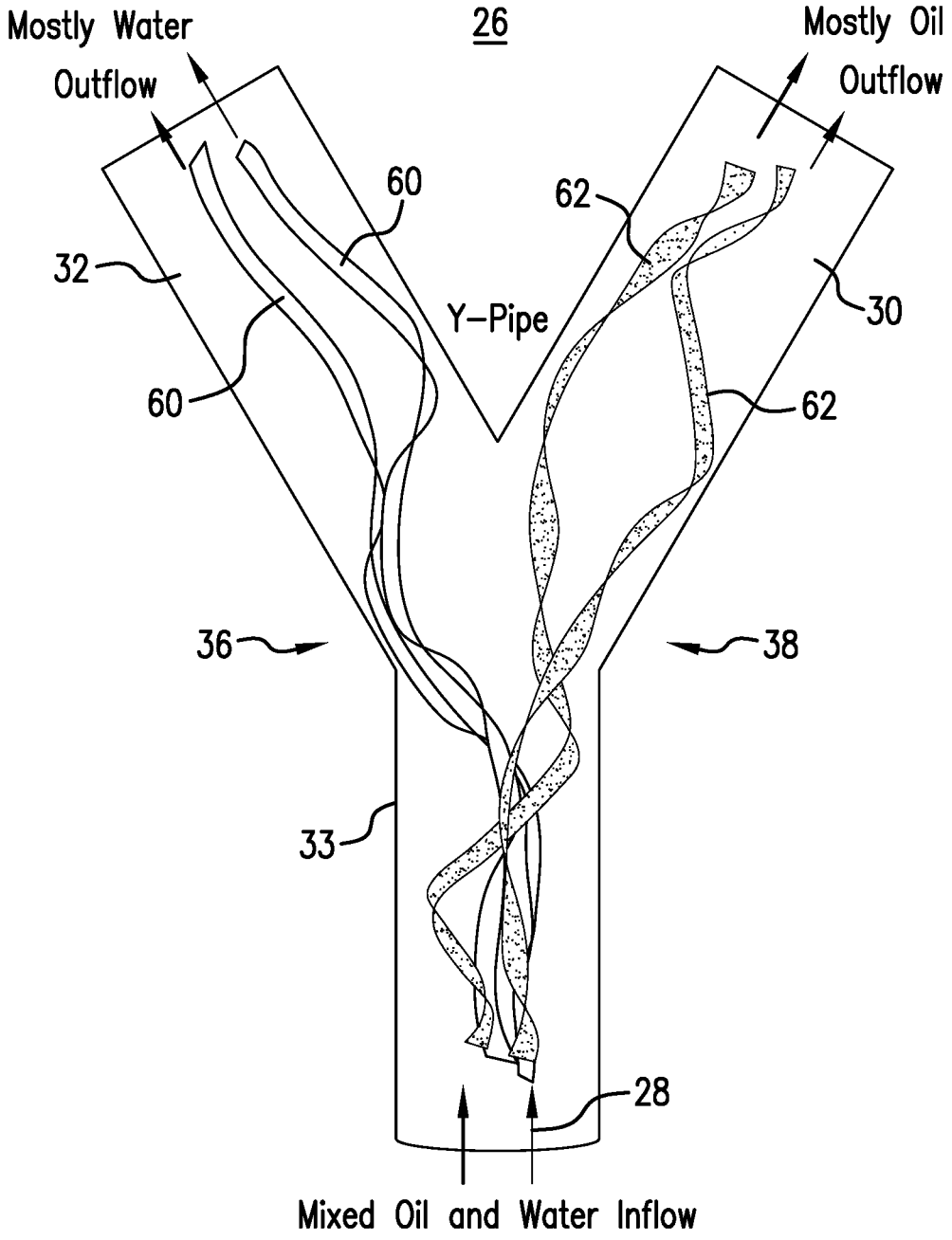
FIG. 2 depicts an embodiment of a downhole fluid separation assembly including hydrophilic and oleophilic ribbons disposed within one or more fluid conduits.

FIG. 2 depicts an embodiment of the separation system 26, in which the separation components are configured as flexible ribbons. The ribbons may have an elongated and flat structure, selected to provide a sufficient surface area to achieve separation by selectively directing hydrocarbon fluids and water-based fluids. As described herein, a "ribbon" is a flexible body having a selected surface area and is not limited to any specific length, size, thickness or other dimension.

In an example, the oleophilic separation component 38 includes a plurality of oleophilic (oil-wet) ribbons 62. Each oleophilic ribbon 62 is made from or includes (e.g., as a coating or outer layer) an oleophilic and hydrophobic material, such as a hydrophobic polymer (e.g., Melamine), or a woven or fibrous material made from a hydrophobic material or coated with a hydrophobic. Each oleophilic ribbon 62 is attached at a first end to an interior surface or interior location of the inflow conduit 33, and has an opposite end ("free end") that can advance with fluid and float within a conduit. The ribbons can be attached at any suitable location, such as at or near the entrance into the inflow conduit 33. In this example, each oleophilic ribbon 62 has a sufficient length such that a portion of the ribbon 62 extends from the inflow conduit into a length of the production outflow conduit 30.

Also in this example, the hydrophilic separation component 36 includes a plurality of hydrophilic ribbons 60. Each hydrophilic ribbon 60 is made from or includes (e.g., as a coating or outer layer) a hydrophilic and oleophobic material, such as a hydrophilic polymer (e.g., untreated Kevlar with its polar hydroxyl groups), an inorganic material such as glass, and/or an organic material (e.g., jute fibers). Each hydrophilic ribbon 60 is attached at a first end to an interior surface or interior location of the inflow conduit 33, and has an opposite free end that can advance with fluid and float within a conduit. In this example, each hydrophilic ribbon 60 has a sufficient length such that a portion of the ribbon 60 extends from the inflow conduit 33 into a length of the second outflow conduit 32.

In one embodiment, the separation system 26 include a device, member or mechanism to ensure that the ribbons extend into, and remain within, the desired outflow conduit. This would prevent a ribbon from flowing backwards and end up terminating in the wrong outflow line. For example, to prevent a ribbon that terminates in one outflow conduit from accidentally flowing backwards and ending up terminating in the other outflow conduit (e.g., due to flow turbulence or some other effect), the terminal ends (second ends) of one or more ribbons can be restrained to remain within their intended flow line by a loose tether that is tied or otherwise attached to the inside of the intended flow line.

Figure 3:
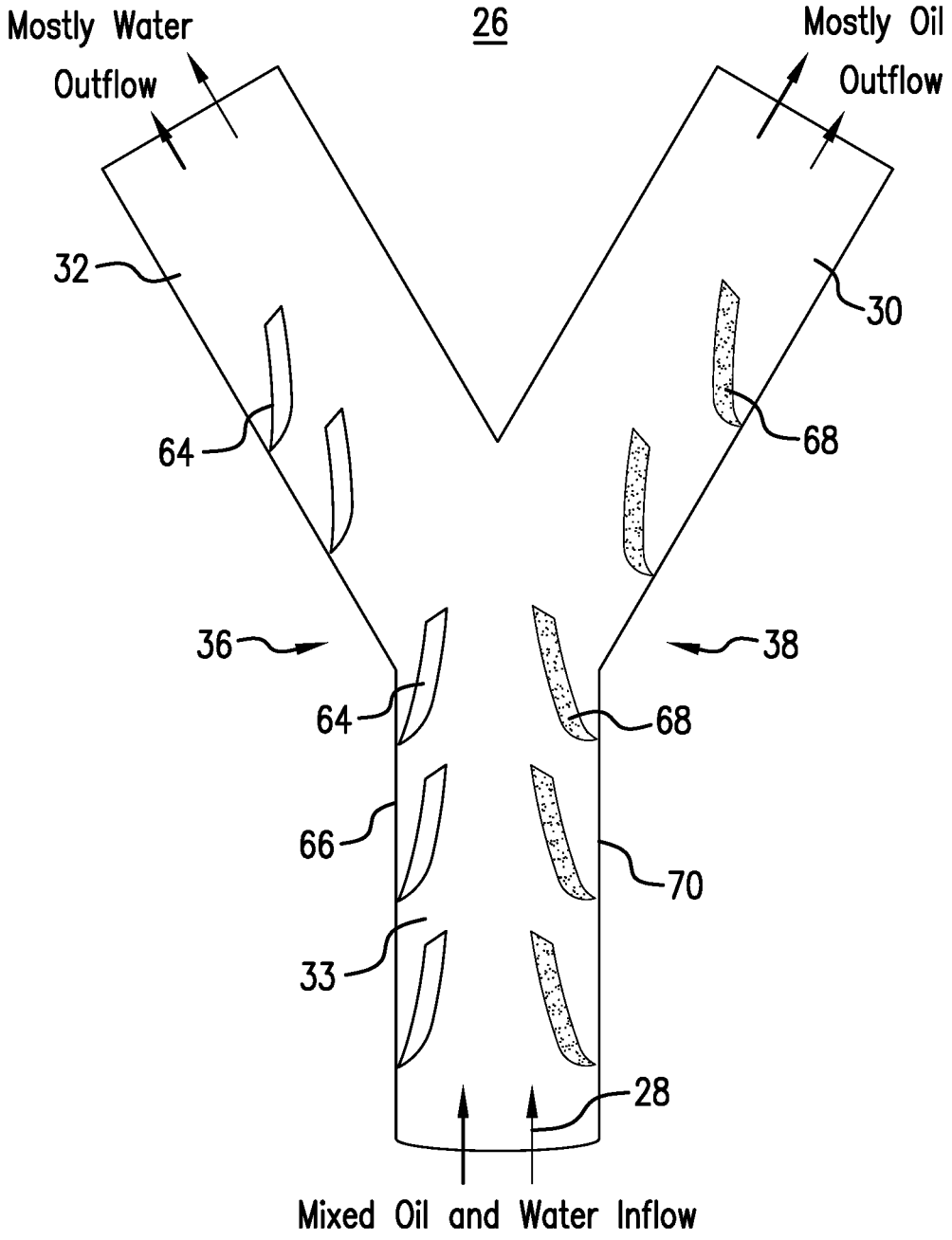
FIG. 3 depicts an embodiment of a downhole fluid separation assembly including hydrophilic and oleophilic ribbons disposed within one or more fluid conduits.

FIG. 3 depicts an embodiment of the separation system 26, in which the oleophilic separation component 38 and the hydrophilic separation component 36 each include a plurality of ribbons that are attached to a surface at one end and extend into a fluid conduit or conduits. The ribbons may be made from flexible material, which can be an integral material such as a metal or polymer strip, a woven material, a fibrous material, or combinations thereof. The ribbons may be made from materials having hydrophilicity or oleophilicity, or be coated or impregnated with hydrophilic or oleophilic material.

For example, the oleophilic separation component 38 includes a plurality of oleophilic ribbons 68 arrayed along a side surface 70 of the inflow conduit 33, where part of the side surface 70 terminates at an entrance to the production outflow conduit 30. The hydrophilic separation component 36 includes a plurality of hydrophilic ribbons 64 arrayed along a side surface 66 terminating at an entrance to the second outflow conduit 32.

The members can be positioned and/or arrayed in any desired configuration. For example, members can be arrayed along a selected length of the inflow conduit 33, and can be arrayed along selected lengths of the outflow conduits. In addition, the density of members can be controlled or varied along the fluid conduits in any desired manner to facilitate separation.

Figure 4:
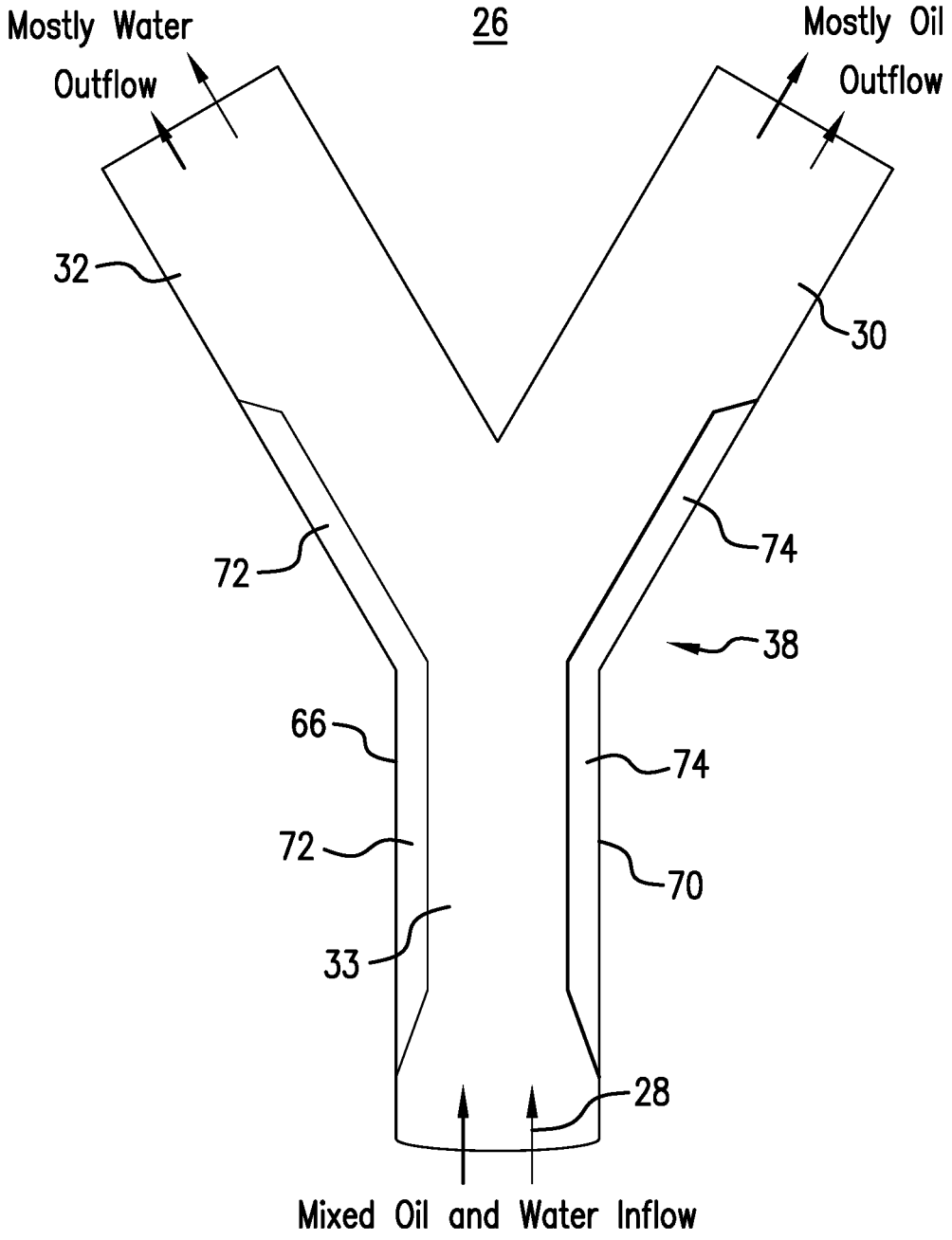
FIG. 4 depicts an embodiment of a downhole fluid separation assembly including hydrophilic and oleophilic components disposed within one or more fluid conduits and configured as stationary components.

FIG. 4 depicts an embodiment of the fluid separation system 26, in which the oleophilic component 38 and the hydrophilic component 36 each include one or more stationary components attached to surfaces of the inflow conduit 33, the production outflow conduit 30 and/or the second outflow conduit 32. It is noted that the stationary components may be configured as stationary ribbons, layers or other bodies. The stationary components may be included alone or in combination with free-flowing ribbons as discussed above.

For example, the oleophilic component 38 includes a layer 74 of an oleophilic material, such as a porous oleophilic material or a porous material having oleophilic coatings, impregnated with oleophilic material, or having structural features that impart oleophilic properties (e.g., pore size, pore density).

The hydrophilic component 36 includes a layer 72 of a hydrophilic material, such as a porous hydrophilic material or a porous material having hydrophilic coatings, impregnated with hydrophilic material, or having structural features that impart hydrophilic properties.

Examples of hydrophilic materials include high temperature polymers such as Kevlar and melamine, hydrophilic inorganic materials such as fiberglass, and natural or organic materials. Hydrophilic materials may also include cellulose based material. Such material may be in the form of fibers. Cellulose-based materials can be derived from a variety of raw materials, such as bagasse, bamboo, cotton, flax, hemp, jute, kenaf and others. In addition, hydrophilic components and ribbons can be formed using a coating or other combination of a hydrophilic material. For example, cellulose-based fibers can be combined with other fibers such as Kevlar fibers.

Examples of oleophilic materials include various high temperature oleophilic and hydrophobic polymers (e.g., hydrophobic acrylics, polyamides, polyimides, polycarbonates, etc.), and carbon-based materials (e.g., carbon fibers), composites and others. In other examples, oleophilic components and ribbons can be made by coating or otherwise incorporating oleophilic materials with other materials. For example, ribbons or filaments can be made from fibers (e.g., woven or bundled) such as cellulose based fibers discussed above, and coated or impregnated with hydrophobic material.

It is noted that embodiments are not limited to the specific materials or combinations of material described herein. Any of a variety of natural, organic or non-organic materials can be used to impart hydrophilic and oleophilic characteristics.

Figure 5:
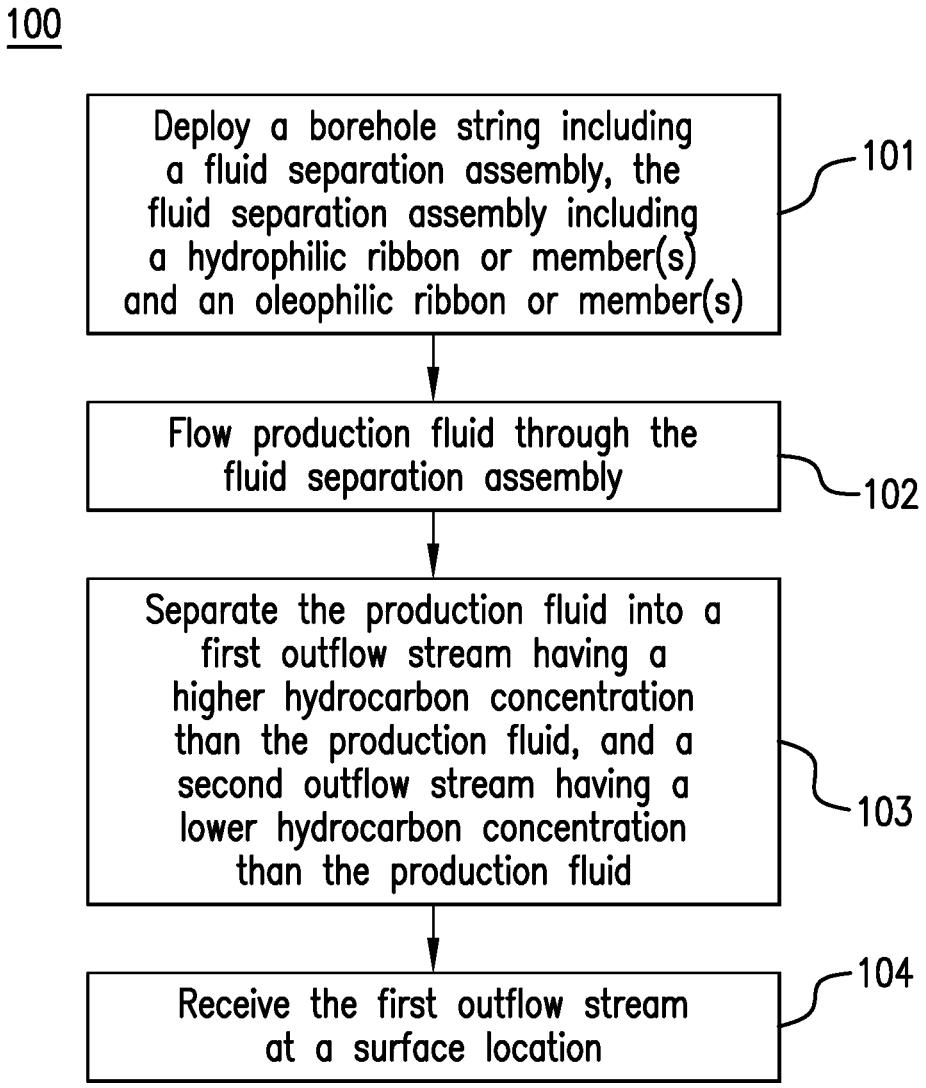
FIG. 5 is a flow chart depicting an embodiment of a method of separating fluid constituents in production fluid.

FIG. 5 is a flow chart that illustrates an embodiment of a method 100 of separating constituents of production fluid and producing fluid from a borehole. Aspects of the method 100 or functions or operations performed in conjunction with the method (e.g., controlling fluid injection and/or production fluid flow rates) may be performed by one or more processing devices, such as the surface processing unit 40, either alone or in conjunction with a human operator.

The method 100 is discussed in conjunction with the system 10 of FIG. 1 and the separation assembly 26 of FIG. 3, for illustration purposes. The method 100 is not so limited, and can be performed in conjunction with any fluid separation device or system having oleophilic and hydrophilic ribbons or other components.

The method 100 includes a number of stages or steps represented by blocks 101-104. In one embodiment, the method 100 includes the execution of all of the stages or steps in the order described. However, certain stages may be omitted, stages may be added, or the order of the stages changed.

At block 101, a production operation is performed. For example, the borehole string 12 is deployed into the borehole 14 and advanced to a selected depth or location along the borehole 14. Various operations may be performed prior to commencing production, such a completion and/or stimulation operations (e.g., perforation and/or hydraulic fracturing).

The borehole string 12 includes a production assembly and a fluid separation assembly such as the separation assembly 26. For example, the separation assembly includes a set of hydrophilic ribbons 60 and oleophilic ribbons 62.

At block 102, production fluid from a subterranean region, such as the formation 16, is received in a production assembly and advances to the separation assembly 26.

At block 103, the production fluid is separated into a production stream that flows into an outflow conduit such as the production outflow conduit 30, and a second outflow stream that flows into a second outflow conduit such as the conduit 32. The ribbons 60 redirect the flow of water-based fluid into the conduit 32 by increasing the surface area at which water-based flow is guided. As a result, the volume of fluid flowing through the conduit 32 has a lower proportion of hydrocarbons than production fluid in the inflow conduit 33.

Likewise, the ribbons 62 redirect the flow of hydrocarbons into the production outflow conduit 30 by increasing the surface area at which hydrocarbons are guided. As a result, the volume of fluid (the production stream) flowing through the conduit 30 has a lower proportion of water, and a higher proportion of hydrocarbons, than production fluid in the inflow conduit 33.

At block 104, the production stream is received at a surface location. Fluid flowing through the conduit 32 may be injected into the formation 16, brought to the surface as wastewater, or processed to extract hydrocarbons therefrom.

Set forth below are some embodiments of the foregoing disclosure:

Embodiment 1: An apparatus for separating fluids and controlling flow of production fluid, comprising: a diversion assembly configured to receive production fluid produced from a subterranean region, the diversion assembly including an inflow conduit in fluid communication with a first outflow conduit and a second outflow conduit, the first outflow conduit in fluid communication with a surface location; and a separation assembly including a hydrophilic ribbon and an oleophilic ribbon configured to be immersed in the production fluid, at least part of the hydrophilic ribbon and the oleophilic ribbon configured to move with the production fluid, the oleophilic ribbon configured to redirect a flow of hydrocarbons into the first outflow conduit, and the hydrophilic ribbon configured to redirect a flow of water-based fluid into the second outflow conduit.

Embodiment 2: The apparatus of any prior embodiment, wherein the hydrophilic ribbon is configured to attract water-based fluid and guide the water-based fluid in a viscous boundary layer toward the first outflow conduit, and the oleophilic ribbon is configured to attract hydrocarbons and guide hydrocarbons in a viscous boundary layer toward the second outflow conduit Embodiment 3: The apparatus of any prior embodiment, wherein at least part of the oleophilic ribbon is disposed proximate to an entrance of the first outflow conduit, and at least part of the hydrophilic ribbon is disposed proximate to an entrance of the second outflow conduit.

Embodiment 4: The apparatus of any prior embodiment, wherein the hydrophilic ribbon has a first end fixedly disposed relative to the inflow conduit and a second end extending into a fluid volume, and the oleophilic ribbon has a first end fixedly disposed relative to the inflow conduit and a second end extending into a fluid volume.

Embodiment 5: The apparatus of any prior embodiment, wherein the hydrophilic ribbon is attached at the inflow conduit and extends into the second outflow conduit, and the oleophilic ribbon is attached at the inflow conduit and extends into the first outflow conduit.

Embodiment 6: The apparatus of any prior embodiment, wherein the hydrophilic ribbon includes a plurality of hydrophilic ribbons arrayed along a first side of the inflow conduit, and the oleophilic ribbon includes a plurality of oleophilic ribbons arrayed along a second side of the inflow conduit opposite to the first side.

Embodiment 7: The apparatus of any prior embodiment, wherein the hydrophilic ribbon is configured to adhere to water-based fluid in the production fluid, and the oleophilic ribbon is configured to adhere to hydrocarbons in the production fluid.

Embodiment 8: The apparatus of any prior embodiment, wherein the hydrophilic ribbon includes a plurality of hydrophilic ribbons, and the oleophilic ribbon includes a plurality of oleophilic ribbons.

Embodiment 9: The apparatus of any prior embodiment, wherein each of the plurality of oleophilic ribbons includes a first end fixedly disposed relative to the inflow conduit and a second end configured to be guided by the production fluid into the first outflow conduit, and each of the plurality of hydrophilic ribbons includes a first end fixedly disposed relative to the inflow conduit and a second end configured to be guided by the production fluid into the second outflow conduit.

Embodiment 10: The apparatus of any prior embodiment, wherein one or more of the hydrophilic and oleophilic ribbons are configured as thin flexible members having flat surfaces.

Embodiment 11: A method of separating fluids and controlling flow of production fluid, comprising: disposing a fluid production apparatus in a borehole in a subterranean region, the apparatus including a diversion assembly having an inflow conduit in fluid communication with a first outflow conduit and a second outflow conduit, the first outflow conduit in fluid communication with a surface location, the apparatus including a separation assembly having a hydrophilic ribbon and an oleophilic ribbon configured to be immersed in the production fluid, at least part of the hydrophilic ribbon and the oleophilic ribbon configured to move with the production fluid; receiving production fluid produced from the subterranean region, the production fluid including an initial proportion of hydrocarbons and an initial proportion of water-based fluid; flowing the production fluid into the inflow conduit; redirecting hydrocarbon fluid in the production fluid to the first outflow conduit by the oleophilic ribbon, to reduce the proportion of the water-based fluid in the first outflow conduit relative to the initial proportion of the water-based fluid; redirecting water-based fluid of the production fluid to the second outflow conduit by the hydrophilic ribbon, to reduce the proportion of the hydrocarbons in the second outflow conduit relative to the initial proportion of the hydrocarbons; and receiving the second portion of the production fluid at a surface location.

Embodiment 12: The method of any prior embodiment, wherein the hydrophilic ribbon is configured to attract water-based fluid and guide the water-based fluid in a viscous boundary layer toward the first outflow conduit, and the oleophilic ribbon is configured to attract hydrocarbons and guide hydrocarbons in a viscous boundary layer toward the second outflow conduit.

Embodiment 13: The method of any prior embodiment, wherein at least part of the hydrophilic ribbon is disposed proximate to an entrance of the second outflow conduit, and at least part of the oleophilic ribbon is disposed proximate to an entrance of the first outflow conduit.

Embodiment 14: The method of any prior embodiment, wherein the hydrophilic ribbon has a first end fixedly disposed relative to the inflow conduit and a second end extending into a fluid volume, and the oleophilic ribbon has a first end fixedly disposed relative to the inflow conduit and a second end extending into a fluid volume.

Embodiment 15: The method of any prior embodiment, wherein the hydrophilic ribbon is attached at the inflow conduit and extends into the second outflow conduit, and the oleophilic ribbon is attached at the inflow conduit and extends into the first outflow conduit.

Embodiment 16: The method of any prior embodiment, wherein the hydrophilic ribbon includes a plurality of hydrophilic ribbons arrayed along a first side of the inflow conduit, and the oleophilic ribbon includes a plurality of oleophilic ribbons arrayed along a second side of the inflow conduit opposite to the first side.

Embodiment 17: The method of any prior embodiment, wherein the hydrophilic ribbon is configured to adhere to water-based fluid in the production fluid, and the oleophilic ribbon is configured to adhere to hydrocarbons in the production fluid.

Embodiment 18: The method of any prior embodiment, wherein the hydrophilic ribbon includes a plurality of hydrophilic ribbons, and the oleophilic ribbon includes a plurality of oleophilic ribbons.

Embodiment 19: The method of any prior embodiment, wherein each of the plurality of oleophilic ribbons includes a first end fixedly disposed relative to the inflow conduit and a second end configured to be guided by the production fluid into the first outflow conduit, and each of the plurality of hydrophilic ribbons includes a first end fixedly disposed relative to the inflow conduit and a second end configured to be guided by the production fluid into the second outflow conduit.

Embodiment 20: The method of any prior embodiment, wherein one or more of the hydrophilic and oleophilic ribbons are configured as thin flexible members having flat surfaces.

In support of the teachings herein, various analysis components may be used, including a digital and/or an analog system. For example, embodiments such as the system 10, downhole tools, hosts and network devices described herein may include digital and/or analog systems. Embodiments may have components such as a processor, storage media, memory, input, output, wired communications link, user interfaces, software programs, signal processors (digital or analog), signal amplifiers, signal attenuators, signal converters and other such components (such as resistors, capacitors, inductors and others) to provide for operation and analyses of the apparatus and methods disclosed herein in any of several manners well-appreciated in the art. It is considered that these teachings may be implemented in conjunction with a set of computer executable instructions stored on a non-transitory computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Elements of the embodiments have been introduced with either the articles "a" or "an." The articles are intended to mean that there are one or more of the elements. The terms "including" and "having" are intended to be inclusive such that there may be additional elements other than the elements listed. The conjunction "or" when used with a list of at least two terms is intended to mean any term or combination of terms. The terms "first," "second" and the like do not denote a particular order, but are used to distinguish different elements.

While one or more embodiments have been shown and described, modifications and substitutions may be made thereto without departing from the spirit and scope of the invention. Accordingly, it is to be understood that the present invention has been described by way of illustrations and not limitation.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus for separating fluids and controlling flow of production fluid, comprising:

a diversion assembly configured to receive the production fluid produced from a subterranean region, the diversion assembly including an inflow conduit in fluid communication with a first outflow conduit and a second outflow conduit, the first outflow conduit in fluid communication with a surface location; and a separation assembly including a hydrophilic ribbon and an oleophilic ribbon configured to be immersed in the production fluid, at least part of the hydrophilic ribbon and the oleophilic ribbon configured to move with the production fluid, the oleophilic ribbon configured to redirect a flow of hydrocarbons of the production fluid into the first outflow conduit, and the hydrophilic ribbon configured to redirect a flow of a water-based fluid of the production fluid into the second outflow conduit.

2. The apparatus of claim 1, wherein the hydrophilic ribbon is configured to attract the flow of the water-based fluid and guide the flow of the water-based fluid in a viscous boundary layer toward the second outflow conduit, and the oleophilic ribbon is configured to attract the flow of the hydrocarbons and guide the flow of the hydrocarbons in a viscous boundary layer toward the first outflow conduit.

3. The apparatus of claim 1, wherein at least part of the oleophilic ribbon is disposed proximate to an entrance of the first outflow conduit, and at least part of the hydrophilic ribbon is disposed proximate to an entrance of the second outflow conduit.

4. The apparatus of claim 1, wherein the hydrophilic ribbon has a first end fixedly disposed relative to the inflow conduit and a second end extending into a fluid volume, and the oleophilic ribbon has a first end fixedly disposed relative to the inflow conduit and a second end extending into the fluid volume.

5. The apparatus of claim 3, wherein the hydrophilic ribbon is attached at the inflow conduit and extends into the second outflow conduit, and the oleophilic ribbon is attached at the inflow conduit and extends into the first outflow conduit.

6. The apparatus of claim 4, wherein the hydrophilic ribbon includes a plurality of hydrophilic ribbons arrayed along a first side of the inflow conduit, and the oleophilic ribbon includes a plurality of oleophilic ribbons arrayed along a second side of the inflow conduit opposite to the first side.

7. The apparatus of claim 1, wherein the hydrophilic ribbon is configured to adhere to the water-based fluid of the production fluid, and the oleophilic ribbon is configured to adhere to the hydrocarbons of the production fluid.

8. The apparatus of claim 1, wherein the hydrophilic ribbon includes a plurality of hydrophilic ribbons, and the oleophilic ribbon includes a plurality of oleophilic ribbons.

9. The apparatus of claim 8, wherein each of the plurality of oleophilic ribbons includes a first end fixedly disposed relative to the inflow conduit and a second end configured to be guided by the production fluid into the first outflow conduit, and each of the plurality of hydrophilic ribbons includes a first end fixedly disposed relative to the inflow conduit and a second end configured to be guided by the production fluid into the second outflow conduit.

10. The apparatus of claim 1, wherein one or more of the hydrophilic and oleophilic ribbons are configured as thin flexible members having flat surfaces.

11. A method of separating fluids and controlling flow of production fluid, comprising:

disposing a fluid production apparatus in a borehole in a subterranean region, the apparatus including a diversion assembly having an inflow conduit in fluid communication with a first outflow conduit and a second outflow conduit, the first outflow conduit in fluid communication with a surface location, the apparatus including a separation assembly having a hydrophilic ribbon and an oleophilic ribbon configured to be immersed in the production fluid, at least part of the hydrophilic ribbon and the oleophilic ribbon configured to move with the production fluid;

receiving the production fluid produced from the subterranean region, the production fluid including an initial proportion of hydrocarbons and an initial proportion of a water-based fluid;

flowing the production fluid into the inflow conduit;

redirecting a flow of the hydrocarbons of the production fluid to the first outflow conduit by the oleophilic ribbon, to reduce the proportion of the water-based fluid in the first outflow conduit relative to the initial proportion of the water-based fluid;

redirecting a flow of the water-based fluid of the production fluid to the second outflow conduit by the hydrophilic ribbon, to reduce the proportion of the hydrocarbons in the second outflow conduit relative to the initial proportion of the hydrocarbons; and receiving the second portion of the production fluid at a surface location.

12. The method of claim 11, wherein the hydrophilic ribbon is configured to attract the flow of the water-based fluid and guide the flow of the water-based fluid in a viscous boundary layer toward the second outflow conduit, and the oleophilic ribbon is configured to attract the flow of the hydrocarbons and guide the flow of the hydrocarbons in a viscous boundary layer toward the first outflow conduit.

13. The method of claim 11, wherein at least part of the hydrophilic ribbon is disposed proximate to an entrance of the second outflow conduit, and at least part of the oleophilic ribbon is disposed proximate to an entrance of the first outflow conduit.

14. The method of claim 11, wherein the hydrophilic ribbon has a first end fixedly disposed relative to the inflow conduit and a second end extending into a fluid volume, and the oleophilic ribbon has a first end fixedly disposed relative to the inflow conduit and a second end extending into the fluid volume.

15. The method of claim 14, wherein the hydrophilic ribbon is attached at the inflow conduit and extends into the second outflow conduit, and the oleophilic ribbon is attached at the inflow conduit and extends into the first outflow conduit.

16. The method of claim 14, wherein the hydrophilic ribbon includes a plurality of hydrophilic ribbons arrayed along a first side of the inflow conduit, and the oleophilic ribbon includes a plurality of oleophilic ribbons arrayed along a second side of the inflow conduit opposite to the first side.

17. The method of claim 11, wherein the hydrophilic ribbon is configured to adhere to the water-based fluid of the production fluid, and the oleophilic ribbon is configured to adhere to the hydrocarbons of the production fluid.

18. The method of claim 11, wherein the hydrophilic ribbon includes a plurality of hydrophilic ribbons, and the oleophilic ribbon includes a plurality of oleophilic ribbons.

19. The method of claim 18, wherein each of the plurality of oleophilic ribbons includes a first end fixedly disposed relative to the inflow conduit and a second end configured to be guided by the production fluid into the first outflow conduit, and each of the plurality of hydrophilic ribbons includes a first end fixedly disposed relative to the inflow conduit and a second end configured to be guided by the production fluid into the second outflow conduit.

20. The method of claim 11, wherein one or more of the hydrophilic and oleophilic ribbons are configured as thin flexible members having flat surfaces.

* * * * *